US011216021B2

(12) United States Patent
Huang

(10) Patent No.: US 11,216,021 B2
(45) Date of Patent: Jan. 4, 2022

(54) CURRENT GENERATION CIRCUIT

(71) Applicant: Realtek Semiconductor Corporation, Hsinchu (TW)

(72) Inventor: Han-Hsiang Huang, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 17/091,144

(22) Filed: Nov. 6, 2020

(65) Prior Publication Data

US 2021/0157352 A1 May 27, 2021

(30) Foreign Application Priority Data

Nov. 25, 2019 (TW) ..... 108142789

(51) Int. Cl.
*G05F 3/26* (2006.01)

(52) U.S. Cl.
CPC ..... *G05F 3/267* (2013.01)

(58) Field of Classification Search
None
See application file for complete search history.

(56) References Cited

U.S. PATENT DOCUMENTS

| | | | | |
|---|---|---|---|---|
| 5,982,201 | A * | 11/1999 | Brokaw | H03F 3/345 323/312 |
| 7,821,324 | B2 * | 10/2010 | Han | G05F 3/245 327/535 |
| 7,944,153 | B2 | 5/2011 | Greenfeld | |
| 8,248,176 | B2 * | 8/2012 | Takano | H03K 3/0231 331/183 |
| 10,331,151 | B1 | 6/2019 | Chu | |
| 2016/0094195 | A1 | 3/2016 | Du et al. | |

FOREIGN PATENT DOCUMENTS

| | | | |
|---|---|---|---|
| TW | 200814080 | A | 3/2008 |
| TW | 201122756 | A | 7/2011 |

* cited by examiner

*Primary Examiner* — Jeffery S Zweizig
(74) *Attorney, Agent, or Firm* — Locke Lord LLP; Tim Tingkang Xia, Esq.

(57) ABSTRACT

A current generation circuit includes a temperature sensing circuit, a resistor element having a resistance, and a current mirror circuit. The temperature sensing circuit is configured to generate a reference voltage having corresponding magnitude according to a temperature of the current generation circuit. The resistor element is coupled with the temperature sensing circuit, and is configured to determine magnitude of a reference current according to the reference voltage and the resistance. The current mirror circuit is coupled with the temperature sensing circuit, and is configured to generate an output current according to the reference current. The temperature sensing circuit and the resistor element both have positive temperature coefficients or negative temperature coefficients.

15 Claims, 9 Drawing Sheets

CURRENT GENERATION CIRCUIT

CROSS-REFERENCE TO RELATED APPLICATION

This application claims priority to Patent Application Number 108142789, filed in Taiwan on Nov. 25, 2019, which is herein incorporated by reference in its entirety.

BACKGROUND

Field of Invention

The present disclosure generally relates to a current generation circuit. More particularly, the present disclosure relates to a current generation circuit capable of generating a temperature-independent constant current.

Description of Related Art

Many components in an integrated circuit change their characteristics with temperature. A feedback system including inductors and transformers can generate a temperature-independent constant current in an integrated circuit, but this approach will increase the circuit complexity. Some circuits (e.g., a bandgap circuit) that are simpler than the feedback system are widely used to generate temperature-independent constant voltages, and the temperature-independent constant voltages are then provided, by additional output pins, to external resistors so as to generate temperature-independent constant currents. However, the additional output pins make the encapsulation process more difficult, and the external resistors may result in significantly additional cost.

SUMMARY

The disclosure provides a current generation circuit including a temperature sensing circuit, a resistor element having a resistance, and a current mirror circuit. The temperature sensing circuit is configured to generate a reference voltage having corresponding magnitude according to a temperature of the current generation circuit. The resistor element is coupled with the temperature sensing circuit, and is configured to determine magnitude of a reference current according to the reference voltage and the resistance. The current mirror circuit is coupled with the temperature sensing circuit, and is configured to generate an output current according to the reference current. The temperature sensing circuit and the resistor element both have positive temperature coefficients or negative temperature coefficients.

It is to be understood that both the foregoing general description and the following detailed description are by examples, and are intended to provide further explanation of the disclosure as claimed.

DETAILED DESCRIPTION

Figure 1:
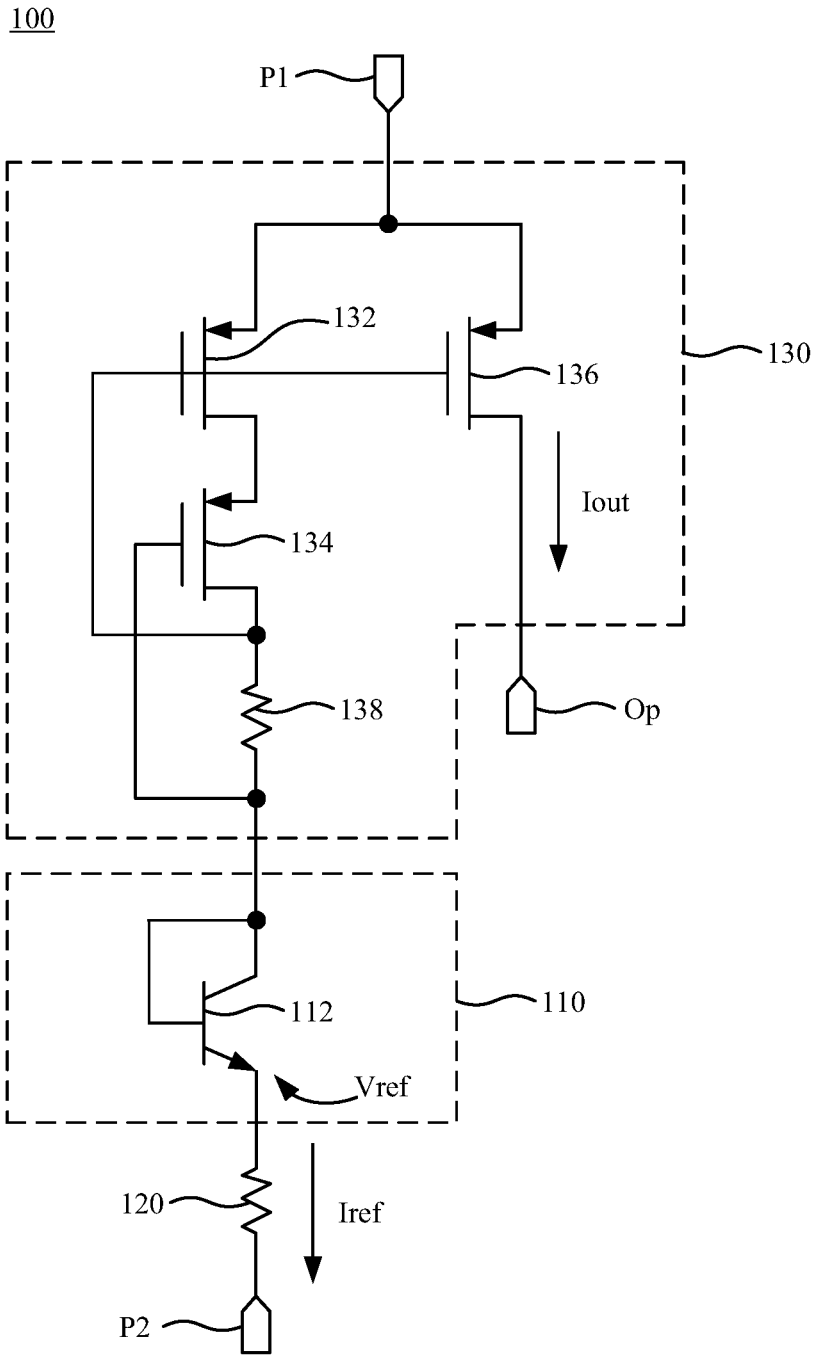
FIG. 1 is a functional block diagram of a current generation circuit according to one embodiment of the present disclosure.

Reference will now be made in detail to the present embodiments of the disclosure, examples of which are illustrated in the accompanying drawings. Wherever possible, the same reference numbers are used in the drawings and the description to refer to the same or like parts.

FIG. 1 is a functional block diagram of a current generation circuit 100 according to one embodiment of the present disclosure. The current generation circuit 100 comprises a temperature sensing circuit 110, a resistor element 120, and a current mirror circuit 130. The temperature sensing circuit 110 is configured to sense temperature of the current generation circuit 100 to generate a sensing result, and is also configured to provide a reference voltage Vref to the resistor element 120. The magnitude of the reference voltage Vref corresponds to the sensing result. The resistor element 120 is coupled with the temperature sensing circuit 110. The resistor element 120 determines, according to the reference voltage Vref, magnitude of the reference current Iref flowing through the resistor element 120. The resistance of the resistor element 120 corresponds to the temperature of the current generation circuit 100 and therefore the magnitude of the reference current Iref does not change with the temperature.

The current mirror circuit 130 is coupled with the temperature sensing circuit 110, and is coupled with the resistor element 120 through the temperature sensing circuit 110. The current mirror circuit 130 is configured to provide the reference current Iref, and is also configured to provide an output current Iout different from the reference current Iref. The reference current Iref and the output current Iout have magnitude corresponding to each other. Accordingly, the magnitude of the output current Iout also does not change with the temperature.

As shown in FIG. 1, the temperature sensing circuit 110 comprises a first sensing transistor 112. The first sensing transistor 112 comprises a first terminal, a second terminal, and a control terminal. The first terminal and the second terminal of the first sensing transistor 112 are coupled with the current mirror circuit 130 and the resistor element 120, respectively, and the second terminal of the first sensing transistor 112 is configured to provide the reference voltage Vref. The control terminal and the first terminal of the first sensing transistor 112 are coupled with each other.

In this embodiment, the first sensing transistor 112 is an NPN bipolar transistor, where the first terminal, the second terminal, and the control terminal of the first sensing transistor 112 are the collector, the emitter, and the base, respectively. In another embodiment, the first sensing transistor 112 may be realized by an N-type metal-oxide-semiconductor (MOS) transistor.

The current mirror circuit 130 comprises a first current transistor 132, a second current transistor 134, a third current transistor 136, and a voltage dividing resistor 138. Each of the first current transistor 132, the second current transistor 134, and the third current transistor 136 comprises a first terminal, a second terminal, and a control terminal. The first terminal and the second terminal of the first current transistor 132 are coupled with the first power terminal P1 and the first terminal of the second current transistor 134, respectively. The second terminal and the control terminal of the second current transistor 134 are coupled with the first terminal and the second terminal of the voltage dividing resistor 138, respectively. The first terminal and the second terminal of the third current transistor 136 are coupled with the first power terminal P1 and the output node Op, respectively. The control terminal of the first current transistor 132 and the control terminal of the third current transistor 136 are coupled with the first terminal of the voltage dividing resistor 138. The third current transistor 136 is configured to provide the output current Iout to the output node Op. Additionally, the second terminal of the voltage dividing resistor 138 is coupled with the first terminal and the control terminal of the first sensing transistor 112.

First terminal and second terminal of the resistor element 120 are coupled with the second terminal of the first sensing transistor 112 and the second power terminal P2, respectively. In this disclosure, the voltage of the first power terminal P1 is higher than that of the second power terminal P2. In one embodiment, the first power terminal P1 is configured to receive an operating voltage, and the second power terminal P2 is connected to ground. Although the resistor element 120 is depicted as a single resistor symbol in FIG. 1, this disclosure is not limited thereto. Each resistor element in this disclosure may, according to practical design requirements, comprise a plurality of resistors that are connected in parallel and/or in series. In addition, each resistor element in this disclosure may be realized by one or more MOS transistors, or by one or more wells formed by ion implantation.

Figure 2:
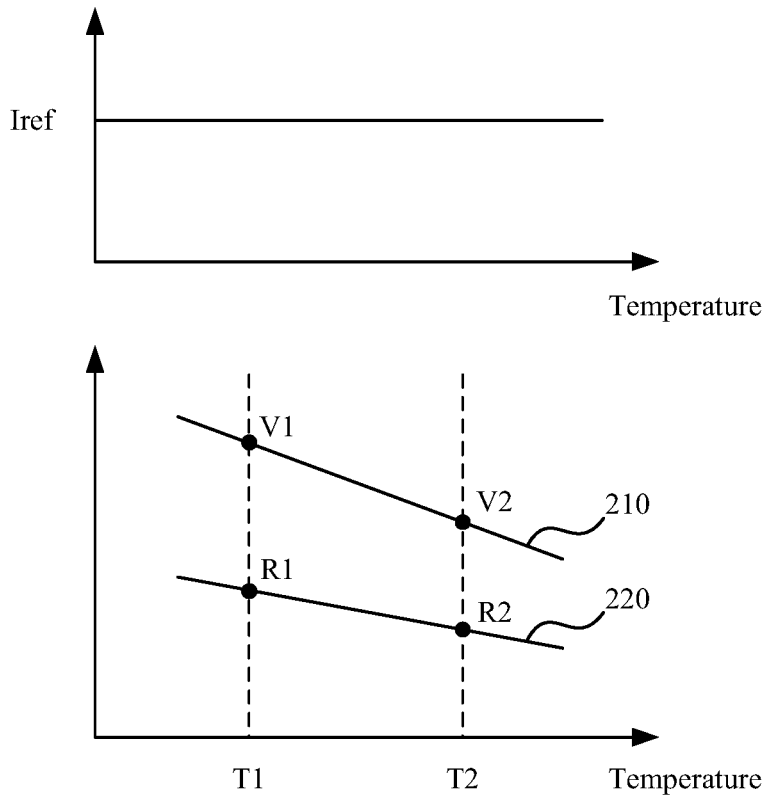
FIG. 2 shows device characteristic schematic diagrams of the temperature sensing circuit and the resistor element of FIG. 1 according to one embodiment of the present disclosure.

FIG. 2 shows device characteristic schematic diagrams of the temperature sensing circuit 110 and the resistor element 120 according to one embodiment of the present disclosure. Reference is made to FIGS. 1 and 2, line 210 is a voltage-to-temperature characteristic line of the reference voltage Vref provided by the temperature sensing circuit 110, and line 220 is a resistance-to-temperature characteristic line of the resistance of the resistor element 120. The temperature sensing circuit 110 and the resistor element 120 both have negative temperature coefficients, that is, the reference voltage Vref and the resistance of the resistor element 120 decrease when the temperature increases. As a result, line 210 and line 220 both have negative slopes.

When the current generation circuit 100 has a first temperature T1, the reference voltage Vref has a first voltage level V1 and the resistor element 120 has a first resistance R1. When the current generation circuit 100 has a second voltage T2, the reference voltage Vref has a second voltage level V2 and the resistor element 120 has a second resistance R2. The relationship between the first voltage level V1 and the second voltage level V2 may be described by Formula 1 as set forth below. The relationship between the first resistance R1 and the second resistance R2 may be described by Formula 2 as set forth below. In the following formulas, symbols A1 and A2 represent slopes of the line 210 and the line 220, respectively.

$$V2=\lambda 1\times(T2-T1)+V1 \quad \text{(Formula 1)}$$

$$R2=\lambda 2\times(T2-T1)+R1 \quad \text{(Formula 2)}$$

In this embodiment, a quotient resulting from dividing the first voltage level V1 by the first resistance R1 is equal to a quotient resulting from dividing the second voltage level V2 by the second resistance R2 so that the magnitude of the reference current Iref is independent of the temperature. In other words, the slope of the line 210 is equal to a fixed multiple of the slope of the line 220. As shown in Formula 3, by dividing the slope of the line 210 by the slope of the line 220, a constant (represented by symbol K) larger than or equal to 0 is obtained.

$$\lambda 1/\lambda 2=K \quad \text{(Formula 3)}$$

In some embodiments, the magnitude of the reference current Iref, e.g., K ampere (A), is equal to the quotient resulting from dividing the slope of the line 210 by the slope of the line 220.

In other embodiments, the current generation circuit 100 may face some manufacturing defects. As a consequence, the slope of the line 210 may be substantially equal to the fixed multiple of the slope of the line 220, that is, the quotient, resulting from dividing the slope of the line 210 by the slope of the line 220, may be 80%-120% of the aforementioned constant.

Figure 3:
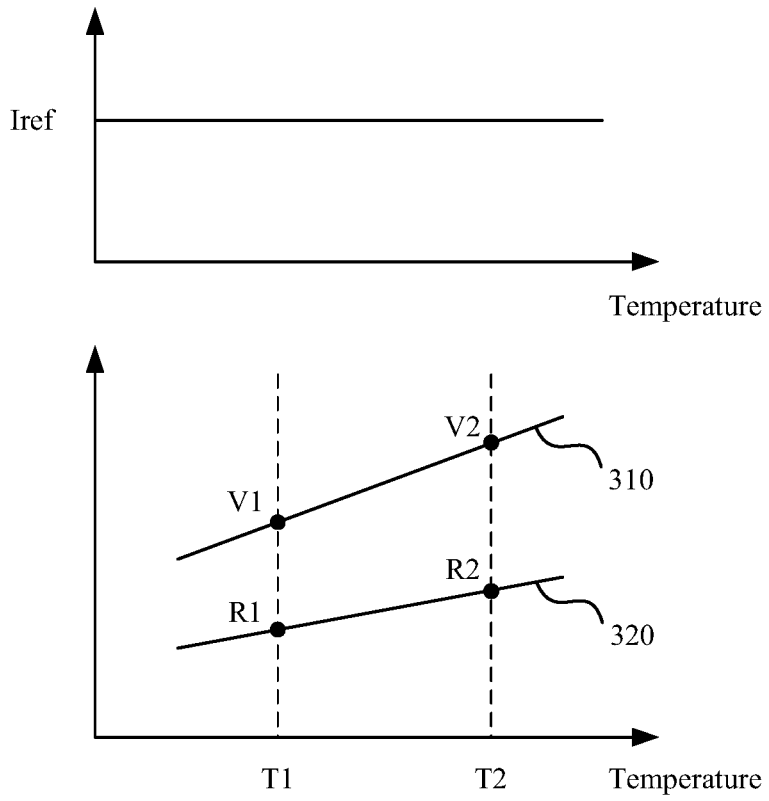
FIG. 3 shows device characteristic schematic diagrams of the temperature sensing circuit and the resistor element of FIG. 1 according to another embodiment of the present disclosure.

FIG. 3 shows device characteristic schematic diagrams of the temperature sensing circuit 110 and the resistor element 120 according to another embodiment of the present disclosure. Reference is made to FIGS. 1 and 3, line 310 is a voltage-to-temperature characteristic line of the reference voltage Vref provided by the temperature sensing circuit 110, and line 320 is the resistance-to-temperature characteristic line of the resistance of the resistor element 120. The temperature sensing circuit 110 and the resistor element 120 both have positive temperature coefficients and therefore the line 310 and the line 320 both have positive slopes. The slope of the line 310 is equal to (or substantially equal to) a fixed multiple of the slope of the line 320, that is, a constant (or a value between 80%-120% of the constant) may be obtained by dividing the slope of the line 310 by the slope of the line 320. As a result, the magnitude of both of the reference current Iref and the output current Iout are independent of the temperature.

Figure 4:
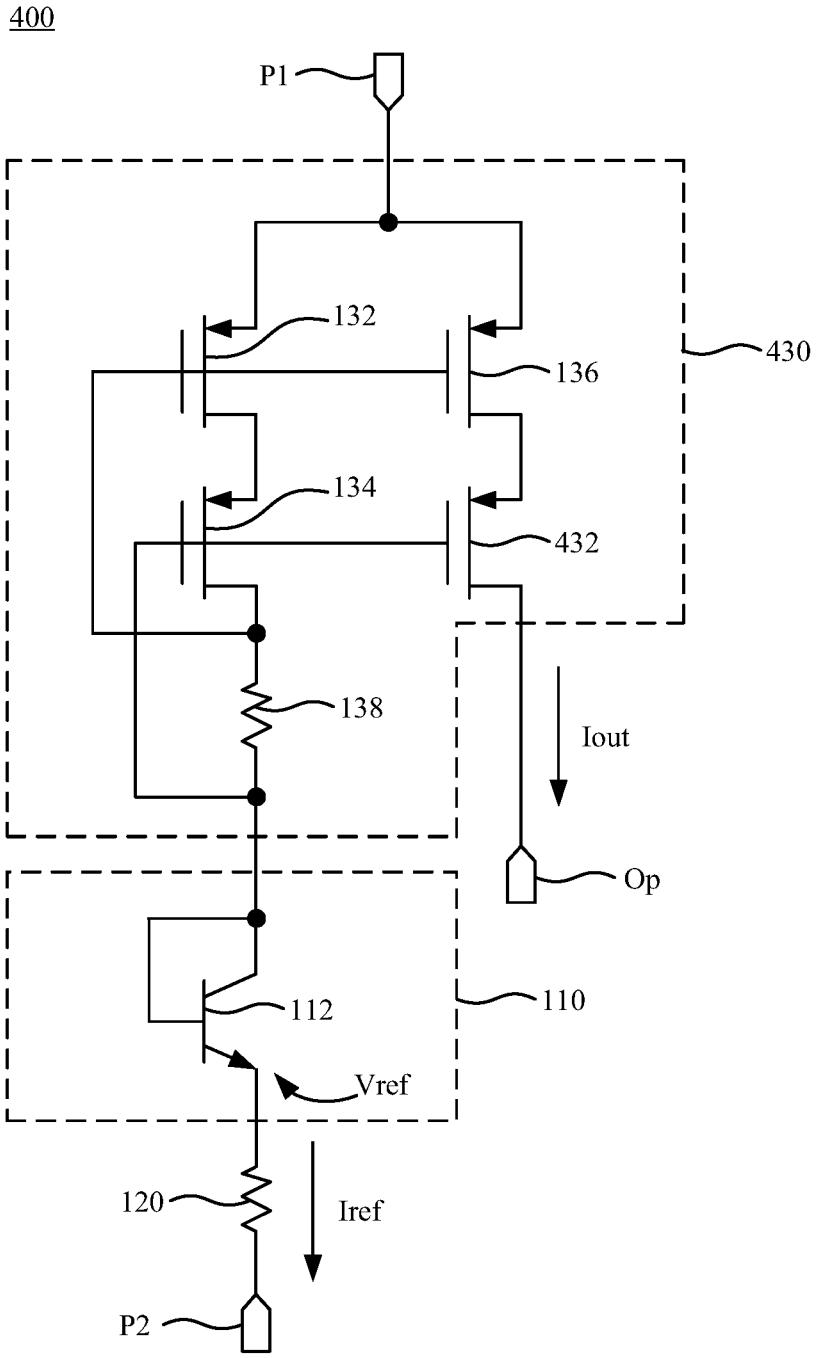
FIG. 4 is a functional block diagram of a current generation circuit according to one embodiment of the present disclosure.

FIG. 4 is a functional block diagram of a current generation circuit 400 according to one embodiment of the present disclosure. The current generation circuit 400 of FIG. 4 is similar to the current generation circuit 100 of FIG. 1, the difference is that the current mirror circuit 430 of the current generation circuit 400 further comprises a fourth current transistor 432. The fourth current transistor 432 comprises a first terminal, a second terminal, and a control terminal. The first terminal and the second terminal of the fourth current transistor 432 are coupled with the second terminal of the third current transistor 136 and the output node Op, respectively. The control terminal of the fourth current transistor 432 is coupled with the control terminal of the second current transistor 134, and is also coupled with the second terminal of the voltage dividing resistor 138. The foregoing descriptions regarding to other corresponding implementations, connections, operations, and related advantages of the current generation circuit 100 are also applicable to the current generation circuit 400. For the sake of brevity, those descriptions will not be repeated here.

Figure 5:
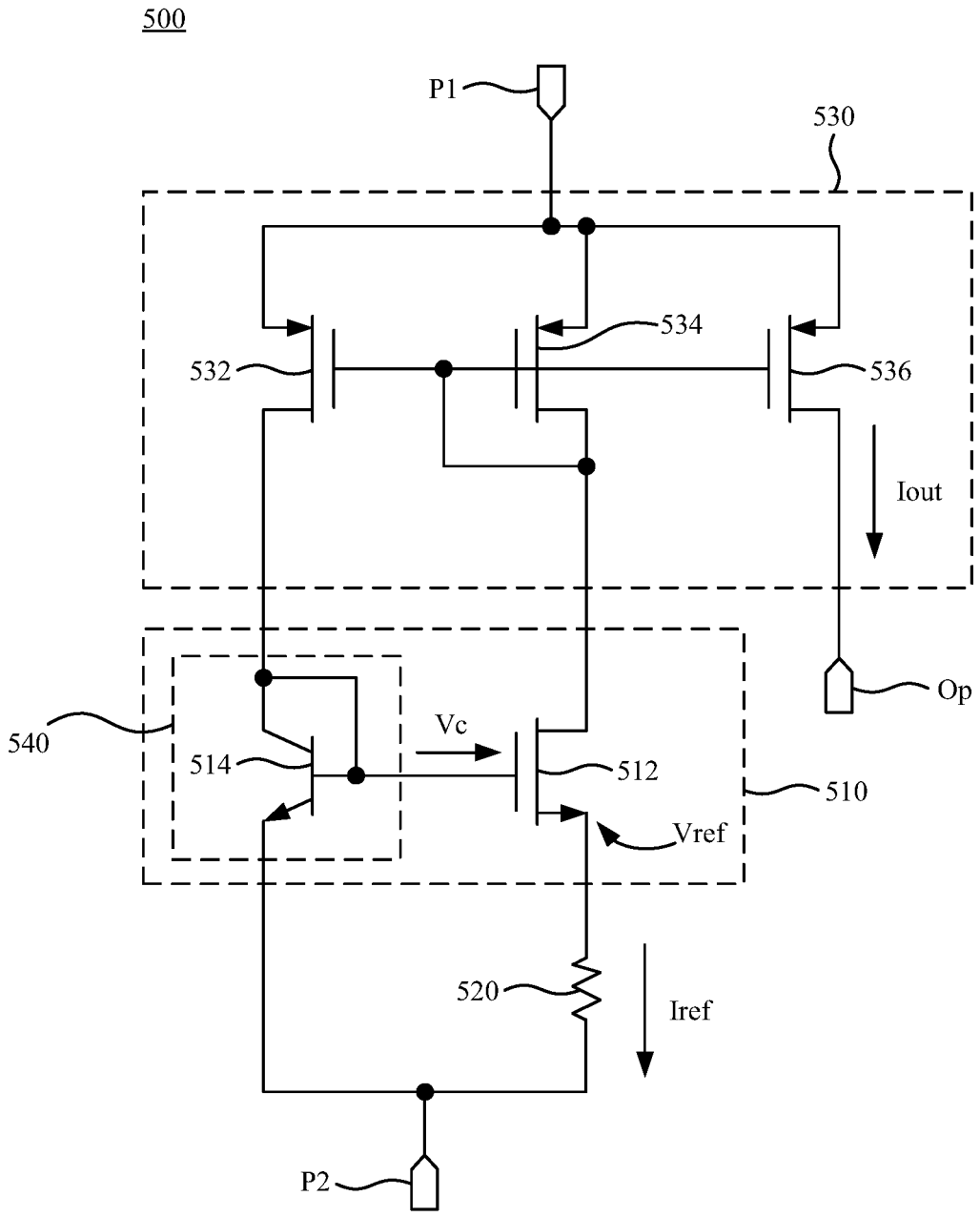
FIG. 5 is a functional block diagram of a current generation circuit according to one embodiment of the present disclosure.

FIG. 5 is a functional block diagram of a current generation circuit 500 according to one embodiment of the present disclosure. The current generation circuit 500 comprises a temperature sensing circuit 510, a resistor element 520, and a current mirror circuit 530. The temperature sensing circuit 510 is configured to sense temperature of the current generation circuit 500 to generate a sensing result, and is configured to provide a reference voltage Vref having a corresponding magnitude to the resistor element 520. The resistor element 520 is coupled with the temperature sensing circuit 510. The resistor element 520 determines, according to the reference voltage Vref, the magnitude of the reference current Iref, and the resistance of the resistor element 520 changes with the temperature of the current generation circuit 500. The current mirror circuit 530 is coupled with the temperature sensing circuit 510, and is coupled with the resistor element 520 through the temperature sensing circuit 510. The current mirror circuit 530 is configured to provide the reference current Iref, and is also configured to generate the output current Iout. The reference current Iref and the output current Iout have magnitude corresponding to each other, and the magnitude of both of the reference current Iref and the output current Iout are independent of the temperature.

As shown in FIG. 5, the current mirror circuit 530 comprises a first current transistor 532, a second current transistor 534, and a third current transistor 536. Each of the first current transistor 532, the second current transistor 534, and the third current transistor 536 comprises a first terminal, a second terminal, and a control terminal. The first terminal and the second terminal of the first current transistor 532 are coupled with the first power terminal P1 and the temperature sensing circuit 510, respectively. The first terminal and the second terminal of the second current transistor 534 are coupled with the first power terminal P1 and the temperature sensing circuit 510, respectively, and the second current transistor 534 is configured to provide the reference current Iref. The first terminal and the second terminal of the third current transistor 536 are coupled with the first power terminal P1 and the output node Op, respectively, and the third current transistor 536 is configured to provide the output current Iout. The control terminal of the first current transistor 532, the control terminal of the second current transistor 534, and the control terminal of the third current transistor 536 are coupled with each other, and are also coupled with the second terminal of the second current transistor 534.

The temperature sensing circuit 510 comprises a first sensing transistor 512 and a control circuit 540. The first sensing transistor 512 comprises a first terminal, a second terminal, and a control terminal. The first terminal and the second terminal of the first sensing transistor 512 are coupled with the second terminal of the second current transistor 534 and the first terminal of the resistor element 520, respectively. The control circuit 540 is configured to output, according to the temperature of the current generation circuit 500, a control voltage Vc having corresponding magnitude to the control terminal of the first sensing transistor 512 so as to determine the magnitude of the reference voltage Vref. The control circuit 540 comprises a second sensing transistor 514 comprising a first terminal, a second terminal, and a control terminal. The first terminal and the control terminal of the second sensing transistor 514 are configured to provide the control voltage Vc, and are both coupled with the second terminal of the first current transistor 532 and the control terminal of the first sensing transistor 512. The second terminal of the second sensing transistor 514 is coupled with the second power terminal P2. In addition, the second terminal of the resistor element 520 is coupled with the second power terminal P2.

In this embodiment, the second sensing transistor 514 and the resistor element 520 both have negative temperature coefficients, that is, the control voltage Vc provided by the second sensing transistor 514 and the resistance of the resistor element 520 decrease when the temperature increases. The first sensing transistor 512 may be a native transistor, that is, the threshold voltage of the first sensing transistor 512 is close to 0 (e.g., 0.2 V). Therefore, the reference voltage Vref approaches to the control voltage Vc, and the reference voltage Vref decreases when the temperature increases. In other embodiments, the first sensing transistor 512 is not limited to the native transistor. The relationship, which one is equal to (or approximately equal to) the fixed multiple of the other one, between the slopes of the line 210 and the line 220 of FIG. 2 may also be applied between a voltage-to-temperature characteristic line (not shown) of the reference voltage Vref of FIG. 5 and the resistance-to-temperature characteristic line (not shown) of the resistor element 520 of FIG. 5. For the sake of brevity, those descriptions will not be repeated here. As a result, the reference current Iref and the output current Iout of the current generation circuit 500 both have magnitude that are independent of the temperature.

In another embodiment, the second sensing transistor 514 and the resistor element 520 both have positive temperature coefficients, that is, the control voltage Vc and the resistance of the resistor element 520 increase when the temperature increases. The relationship, which one is equal to (or approximately equal to) the fixed multiple of the other one, between the slopes of the line 310 and the line 320 of FIG. 3 may also be applied between the voltage-to-temperature characteristic line (not shown) of the reference voltage Vref of FIG. 5 and the resistance-to-temperature characteristic line (not shown) of the resistor element 520 of FIG. 5. For the sake of brevity, those descriptions will not be repeated here. As a result, the reference current Iref and the output current Iout of the current generation circuit 500 both have magnitude that are independent of the temperature.

In this embodiment, the first sensing transistor 512 may be realized by an N-type MOS transistor of any suitable category, for example, the native transistor, the normal mode transistor, the enhancement mode transistor, and the depletion mode transistor. In another embodiment, the first sensing transistor 512 may be realized by an NPN bipolar transistor, where the first terminal, the second terminal, and the control terminal of the first sensing transistor 512 are the collector, the emitter, and the base, respectively.

Figure 6:
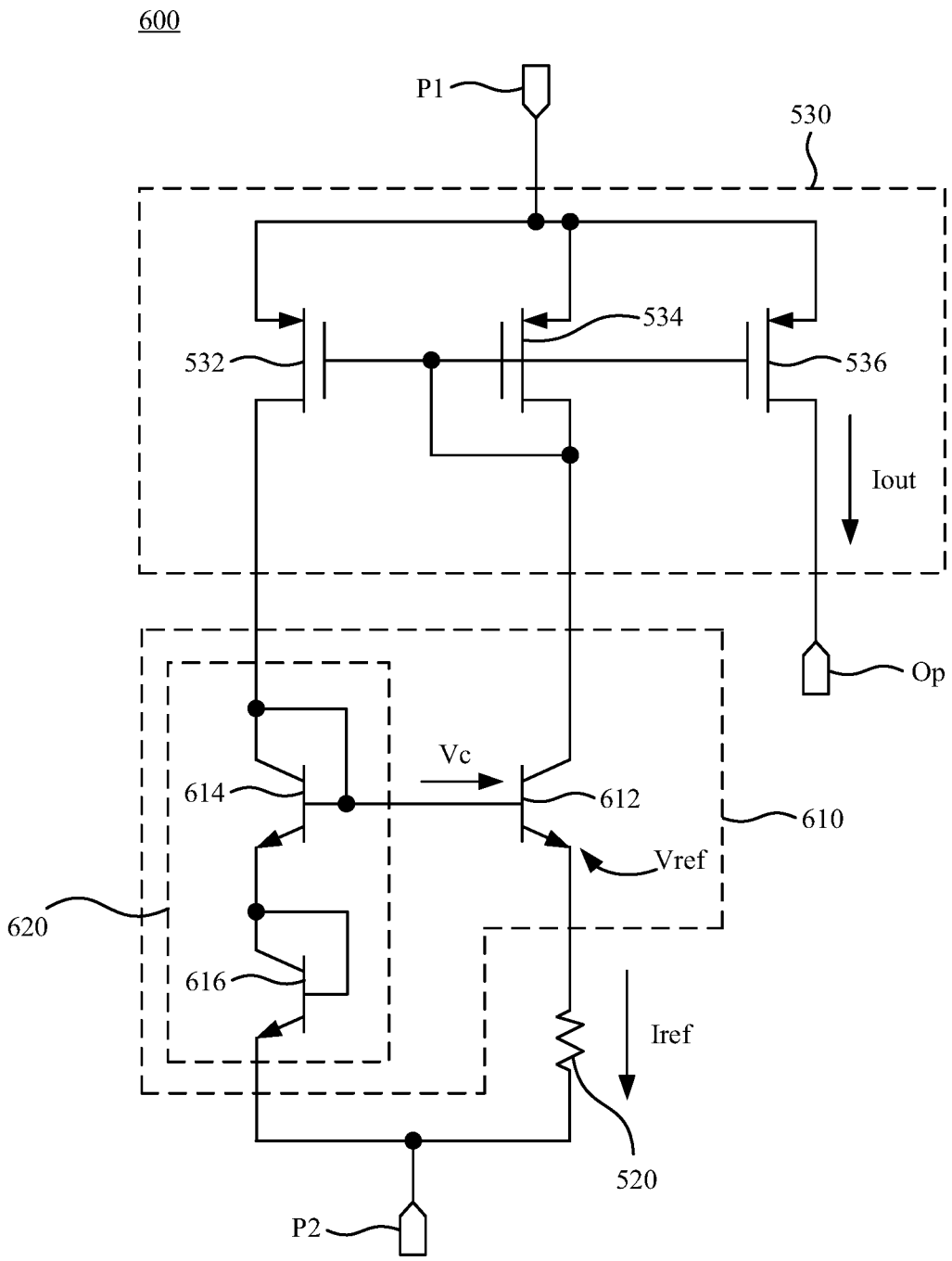
FIG. 6 is a functional block diagram of a current generation circuit according to one embodiment of the present disclosure.

FIG. 6 is a functional block diagram of a current generation circuit 600 according to one embodiment of the present disclosure. The current generation circuit 600 is similar to the current generation circuit 500, and the difference is that the temperature sensing circuit 610 of the current generation circuit 600 is different from the temperature sensing circuit 510 of the current generation circuit 500. The temperature sensing circuit 610 comprises a first sensing transistor 612 and a control circuit 620. The first sensing transistor 612 comprises a first terminal, a second terminal, and a control terminal. The first terminal and second terminal of the first sensing transistor 612 are coupled with the second terminal of the second current transistor 534 and the first terminal of the resistor element 520, respectively.

The control circuit 620 is configured to output, according to temperature of the current generation circuit 600, the control voltage Vc having the corresponding magnitude to the control terminal of the first sensing transistor 612 so as to determine the magnitude of the reference voltage Vref. The control circuit 620 comprises a second sensing transistor 614 and a third sensing transistor 616. Each of the second sensing transistor 614 and the third sensing transistor 616 comprises a first terminal, a second terminal, and a control terminal. The first terminal and the control terminal of the second sensing transistor 614 are configured to provide the control voltage Vc, and are both coupled with the second terminal of the first current transistor 532 and the control terminal of the first sensing transistor 612. The first terminal and the control terminal of the third sensing transistor 616 are coupled with the second terminal of the second sensing transistor 614. The second terminal of the third sensing transistor 616 is coupled with the second power terminal P2.

In this embodiment, the first sensing transistor 612, the second sensing transistor 614, and the third sensing transistor 616 are NPN bipolar transistors, and all have negative temperature coefficients. Therefore, the base-emitter voltage of each of the first sensing transistor 612, the second sensing transistor 614, and the third sensing transistor 616 decreases when the temperature increases. The reference voltage Vref is equal to the voltage of the second terminal of the second sensing transistor 614 and therefore the reference voltage Vref also decreases when the temperature increases. The relationship, which one is equal to (or approximately equal to) the fixed multiple of the other one, between the slopes of the line 210 and the line 220 of FIG. 2 may also be applied between a voltage-to-temperature characteristic line (not shown) of the reference voltage Vref of FIG. 6 and the resistance-to-temperature characteristic line (not shown) of the resistor element 520 of FIG. 6. For the sake of brevity, those descriptions will not be repeated here. As a result, the reference current Iref and the output current Iout of the current generation circuit 600 both have magnitude that are independent of the temperature.

In another embodiment, the first sensing transistor 612, the second sensing transistor 614, and the third sensing transistor 616 all have positive temperature coefficients and therefore the reference voltage Vref increases when the temperature increases. The relationship, which one is equal to (or approximately equal to) the fixed multiple of the other one, between the slopes of the line 310 and the line 320 of FIG. 3 may also be applied between the voltage-to-temperature characteristic line (not shown) of the reference voltage Vref of FIG. 6 and the resistance-to-temperature characteristic line (not shown) of the resistor element 520 of FIG. 6. For the sake of brevity, those descriptions will not be repeated here. As a result, the reference current Iref and the output current Iout of the current generation circuit 600 both have magnitude that are independent of the temperature.

Figure 7:
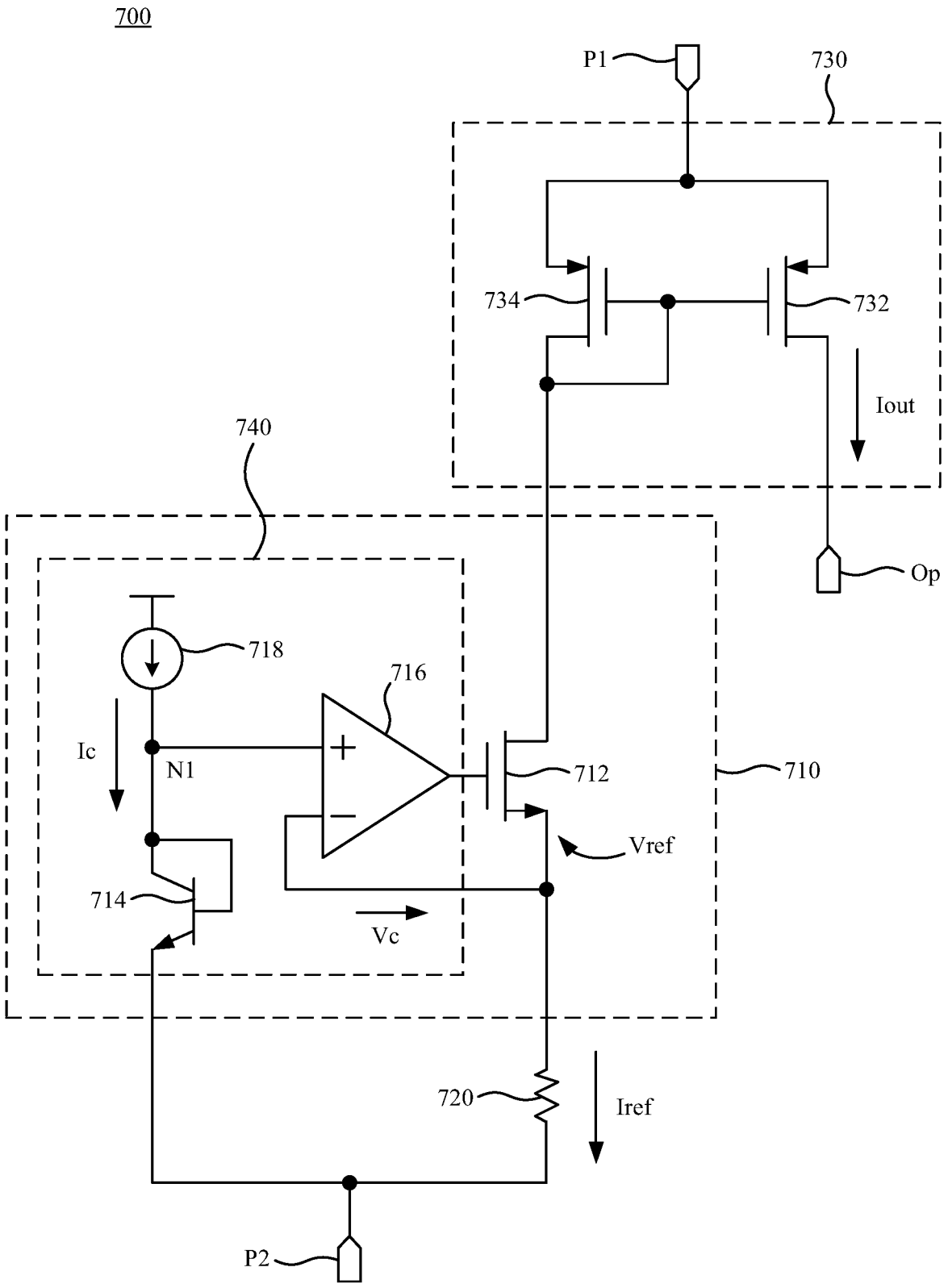
FIG. 7 is a functional block diagram of a current generation circuit according to one embodiment of the present disclosure.

FIG. 7 is a functional block diagram of a current generation circuit 700 according to one embodiment of the present disclosure. The current generation circuit 700 comprises a temperature sensing circuit 710, a resistor element 720, and a current mirror circuit 730. The temperature sensing circuit 710 is configured to sense temperature of the current generation circuit 700 to generate a sensing result, and is also configured to provide a reference voltage Vref having corresponding magnitude to the resistor element 720 coupled with the temperature sensing circuit 710. The resistor element 720 determines, according to the reference voltage Vref, the magnitude of the reference current Iref, and the resistance of the resistor element 720 changes with the temperature of the current generation circuit 700. The current mirror circuit 730 is coupled with the temperature sensing circuit 710, and is coupled with the resistor element 720 through the temperature sensing circuit 710. The current mirror circuit 730 is configured to provide the reference current Iref, and is also configured to generate the output current Iout. The reference current Iref and the output current Iout have magnitude corresponding to each other, and magnitude of both of the reference current Iref and the output current Iout are independent of the temperature.

The current mirror circuit 730 comprises a first current transistor 732 and a second current transistor 734. The first current transistor 732 and the second current transistor 734 both comprise a first terminal, a second terminal, and a control terminal. The first terminal and the second terminal of the first current transistor 732 are coupled with the first power terminal P1 and the temperature sensing circuit 710, respectively. The first terminal and the second terminal of the second current transistor 734 are coupled with the first power terminal P1 and the output node Op, respectively, and the second terminal of the second current transistor 734 is configured to provide the output current Iout. The control terminals of the first current transistor 732 and the second current transistor 734 are both coupled with the second terminal of the first current transistor 732.

The temperature sensing circuit 710 comprises a first sensing transistor 712 and a control circuit 740. The first sensing transistor 712 comprises a first terminal, a second terminal, and a control terminal. The first terminal and the second terminal of the first sensing transistor 712 are coupled with the second terminal of the first current transistor 732 and the resistor element 720, respectively. The second terminal of the first sensing transistor 712 is configured to provide the reference voltage Vref. The control circuit 740 is configured to output, according to the temperature of the current generation circuit 700, the control voltage Vc to the second terminal of the first sensing transistor 712 so as to determine the magnitude of the reference voltage Vref.

The control circuit 740 comprises a second sensing transistor 714, a amplifier 716, and a current source 718. The second sensing transistor 714 comprises a first terminal, a second terminal, and a control terminal. The first terminal and the second terminal of the second sensing transistor 714 are coupled with the first node N1 and the second power terminal P2, respectively. The first terminal and the control terminal of the second sensing transistor 714 are coupled with each other. The amplifier 716 comprises a first input terminal (e.g., a non-inverted input terminal), a second input terminal (e.g., an inverted input terminal), and an output node. The first input terminal of the amplifier 716 is coupled with the first node N1, the second input terminal is coupled with the second terminal of the first sensing transistor 712, and the second input terminal is configured to provide the control signal Vc. The output node of the amplifier 716 is coupled with the control terminal of the first sensing transistor 712. The current source 718 is configured to provide the control current Ic to the first node N1.

Figure 8:
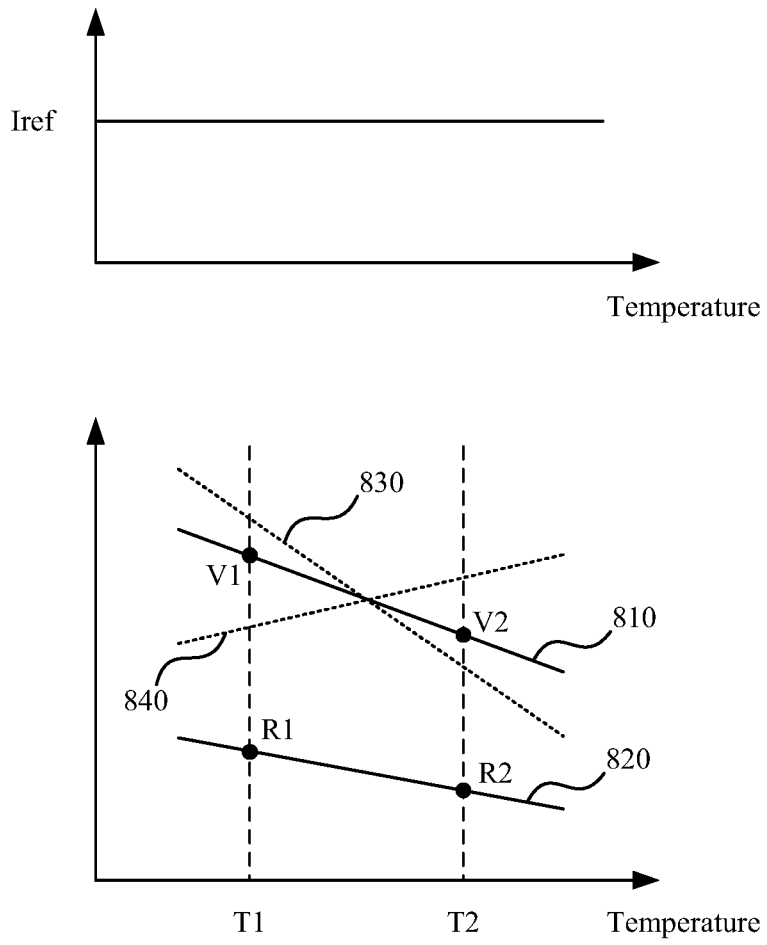
FIG. 8 shows device characteristic schematic diagrams of the temperature sensing circuit and the resistor element of FIG. 7 according to one embodiment of the present disclosure.

FIG. 8 shows device characteristic schematic diagrams of the temperature sensing circuit 710 and the resistor element 720 according to one embodiment of the present disclosure. Line 810 is the voltage-to-temperature characteristic line of the reference voltage Vref. Line 820 is the resistance-to-temperature characteristic line of the resistor element 720. Reference is made to FIGS. 7 and 8, the temperature sensing circuit 710 and the resistor element 720 both have negative temperature coefficients. Therefore, the reference voltage Vref and the resistance of the resistor element 720 decrease when the temperature increases. The slope of the line 810 is equal to (or approximately equal to) a fixed multiple of the slope of the line 820 so that the reference current Iref and the output current Iout both have magnitude that are independent of the temperature.

Line 830 is a current-to-temperature characteristic line of the control current Ic. Line 840 is a voltage-to-temperature characteristic line of a control terminal voltage of the second sensing transistor 714. The second sensing transistor 714 and the current source 718 have temperature coefficients opposite to each other. For example, if the second sensing transistor 714 has a positive temperature coefficient, the current source 718 has a negative temperature coefficient, and vice versa. Therefore, a product resulting from multiplying the slope of the line 830 with the slope of the line 840 is less than 0. The control current Ic may be a constant current, and the voltage-to-temperature trend of the first node N1 can be determined by adjusting the magnitude of the control current Ic and the device characteristic of the second sensing transistor 714. Since the first input terminal and the second input terminal of the amplifier 716 are virtually grounded, the reference voltage Vref is equal to the voltage of the first node N1.

In other words, the slope of the line 810 can be determined by adjusting the slope of the line 830 and/or the slope of the line 840. Therefore, the slope of the line 810 is between the slopes of the line 830 and the line 840.

Figure 9:
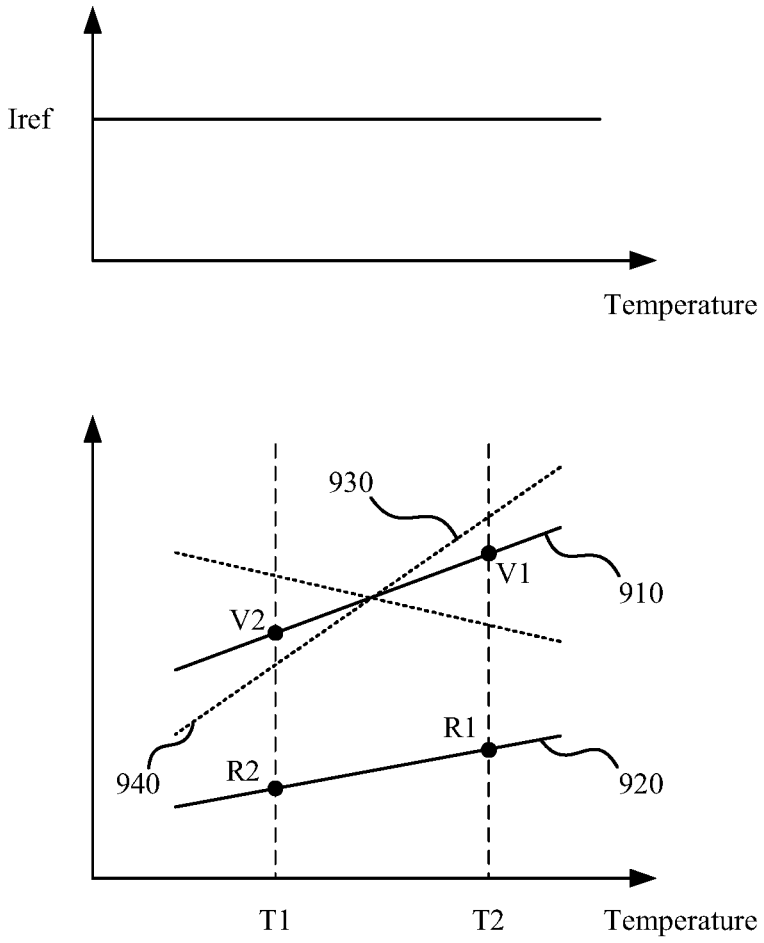
FIG. 9 shows device characteristic schematic diagrams of the temperature sensing circuit and the resistor element of FIG. 7 according to another embodiment of the present disclosure.

FIG. 9 shows device characteristic schematic diagrams of the temperature sensing circuit 710 and the resistor element 720 according to another embodiment of the present disclosure. Line 910 is the voltage-to-temperature characteristic line of the reference voltage Vref. Line 920 is the resistance-to-temperature characteristic line of the resistor element 720. Line 930 is the current-to-temperature characteristic line of the control current Ic. Line 940 is the voltage-to-temperature characteristic line of the control terminal voltage of the second sensing transistor 714. Reference is made to FIGS. 7 and 9, the temperature sensing circuit 710 and the resistor element 720 both have positive temperature coefficients and therefore the reference voltage Vref and the resistance of the resistor element 720 increase when the temperature increases. The slope of the line 910 is equal to (or approximately equal to) a fixed multiple of the slope of the line 920 so that the reference current Iref and the output current Iout both have magnitude that are independent of the temperature. In this situation, the second sensing transistor 714 and the current source 718 also have opposite temperature coefficients, and thus the slope of the line 910 can be determined by adjusting the slope of the line 930 and/or the slope of the line 940.

As can be appreciate from the foregoing descriptions, the current generation circuits 100, 400, 500, 600, and 700 are capable of generating currents that are independent of the temperature by simple circuit structures implemented in the integrated circuits. The current generation circuits 100, 400, 500, 600, and 700 need not to cooperate with additional output pins or external circuits, thereby having the advantage of small circuit area.

Certain terms are used throughout the description and the claims to refer to particular components. One skilled in the art appreciates that a component may be referred to as different names. This disclosure does not intend to distinguish between components that differ in name but not in function. In the description and in the claims, the term "comprise" is used in an open-ended fashion, and thus should be interpreted to mean "include, but not limited to." The term "couple" is intended to compass any indirect or direct connection. Accordingly, if this disclosure mentioned that a first device is coupled with a second device, it means that the first device may be directly or indirectly connected to the second device through electrical connections, wireless communications, optical communications, or other signal connections with/without other intermediate devices or connection means.

The term "and/or" may comprise any and all combinations of one or more of the associated listed items. In addition, the singular forms "a," "an," and "the" herein are intended to comprise the plural forms as well, unless the context clearly indicates otherwise.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A current generation circuit, comprising:

a temperature sensing circuit, configured to generate a reference voltage having corresponding magnitude according to a temperature of the current generation circuit;

a resistor element, coupled with the temperature sensing circuit and having a resistance, and configured to determine magnitude of a reference current according to the reference voltage and the resistance; and a current mirror circuit, coupled with the temperature sensing circuit, and configured to generate an output current according to the reference current, wherein the temperature sensing circuit and the resistor element both have positive temperature coefficients or negative temperature coefficients.

2. The current generation circuit of claim 1, wherein the reference voltage of the temperature sensing circuit has a voltage-to-temperature characteristic line having a first slope, the resistance of the resistor element has a resistance-to-temperature characteristic line having a second slope, a quotient resulting from dividing the first slope by the second slope is equal to K, and K is a constant larger than or equal to 0.

3. The current generation circuit of claim 2, wherein the magnitude of the reference current is K ampere.

4. The current generation circuit of claim 1, wherein the temperature sensing circuit comprises:

a first sensing transistor, comprising a first terminal, a second terminal, and a control terminal, wherein the first terminal of the first sensing transistor and the second terminal of the first sensing transistor are coupled with the current mirror circuit and the resistor element, respectively, and the control terminal of the first sensing transistor is coupled with the first terminal of the first sensing transistor, wherein the second terminal of the first sensing transistor is configured to provide the reference voltage.

5. The current generation circuit of claim 4, wherein the current mirror circuit comprises:

a voltage dividing resistor, comprising a first terminal and a second terminal, wherein the second terminal of the voltage dividing resistor is coupled with the first terminal of the first sensing transistor;

a first current transistor;

a second current transistor, wherein the first current transistor is coupled, in a series connection, with the second current transistor between a first power terminal and the first terminal of the voltage dividing resistor, a control terminal of the second current transistor is coupled with the second terminal of the voltage dividing resistor; and a third current transistor, coupled with the first power terminal, and configured to provide the output current, wherein a control terminal of the third current transistor and a control terminal of the first current transistor are coupled with the first terminal of the voltage dividing resistor.

6. The current generation circuit of claim 5, wherein the current mirror circuit comprises:

a fourth current transistor, wherein the third current transistor is coupled, in a series connection, with the fourth current transistor between the first power terminal and an output node, and a control terminal of the fourth current transistor is coupled with the second terminal of the voltage dividing resistor.

7. The current generation circuit of claim 1, wherein the temperature sensing circuit comprises:

a first sensing transistor, coupled between the current mirror circuit and the resistor element, and configured to provide the reference voltage to the resistor element; and a control circuit, coupled with the current mirror circuit and a control terminal of the first sensing transistor, and configured to output, according to the temperature of the current generation circuit, a control voltage having corresponding magnitude to the first sensing transistor to determine the magnitude of the reference voltage.

8. The current generation circuit of claim 7, wherein the control circuit comprises:

a second sensing transistor, comprising a first terminal, a second terminal, and a control terminal, wherein the control terminal of the second sensing transistor is coupled with the current mirror circuit, the first terminal of the second sensing transistor, and the control terminal of the first sensing transistor, and the control terminal of the second sensing transistor is configured to provide the control voltage.

9. The current generation circuit of claim 8, wherein the control circuit further comprises:

a third sensing transistor, comprising a first terminal, a second terminal, and a control terminal, wherein the control terminal of the third sensing transistor is coupled with the second terminal of the second sensing transistor and the first terminal of the third sensing transistor, and the second terminal of the third sensing transistor is coupled with a second power terminal.

10. The current generation circuit of claim 8, wherein the current mirror circuit comprises:

a first current transistor, coupled between the second sensing transistor and a first power terminal;

a second current transistor, coupled between the first sensing transistor and the first power terminal; and a third current transistor, coupled between the first power terminal and an output node, and configured to provide the output current, wherein a control terminal of the first current transistor, a control terminal of the second current transistor, and a control terminal of the third current transistor are coupled with the first sensing transistor.

11. The current generation circuit of claim 7, wherein the control circuit comprises:

a current source;

an amplifier, comprising a first input terminal, a second input terminal, and an output terminal, wherein the first input terminal of the amplifier is coupled with the current source, the second input terminal of the amplifier is coupled between the first sensing transistor and the resistor element, the second input terminal of the amplifier is configured to provide the control voltage, and the output terminal of the amplifier is coupled with the control terminal of the first sensing transistor; and a second sensing transistor, coupled between the current source and a second power terminal, wherein a control terminal of the second sensing transistor is coupled with the current source.

12. The current generation circuit of claim 11, wherein the current source and the second sensing transistor having temperature coefficients opposite to each other.

13. The current generation circuit of claim 12, wherein the current source is configured to provide a control current to the second sensing transistor, and a product, resulting from multiplying a slope of a current-to-temperature characteristic line of the control current with a slope of a voltage-to-temperature characteristic line of a control terminal voltage of the second sensing transistor, is less than zero.

14. The current generation circuit of claim 13, wherein a voltage-to-temperature characteristic line of the reference voltage having a slope between the slope of the current-to-temperature characteristic line of the control current and the slope of the voltage-to-temperature characteristic line of the control terminal voltage.

15. The current generation circuit of claim 11, wherein the current mirror circuit comprises:

a first current transistor, coupled between a first power terminal and the first sensing transistor; and a second current transistor, coupled between the first power terminal and an output node, and configured to provide the output current, wherein a control terminal of the first current transistor is coupled with a control terminal of the second current transistor.

* * * * *